US009937728B2

(12) United States Patent
Iwamoto et al.

(10) Patent No.: US 9,937,728 B2
(45) Date of Patent: Apr. 10, 2018

(54) THERMAL HEAD AND THERMAL PRINTER

(71) Applicant: KYOCERA Corporation, Kyoto-shi, Kyoto (JP)

(72) Inventors: Yousuke Iwamoto, Kirishima (JP); Youichi Moto, Okaya (JP); Yuuna Ookubo, Kirishima (JP); Arata Okayama, Okaya (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/500,607

(22) PCT Filed: Aug. 22, 2015

(86) PCT No.: PCT/JP2015/073638

§ 371 (c)(1),
(2) Date: Jan. 31, 2017

(87) PCT Pub. No.: WO2016/031740

PCT Pub. Date: Mar. 3, 2016

(65) Prior Publication Data

US 2017/0217203 A1 Aug. 3, 2017

(30) Foreign Application Priority Data

Aug. 26, 2014 (JP) ..... 2014-171726

(51) Int. Cl.
*B41J 2/335* (2006.01)
*B41J 2/345* (2006.01)

(52) U.S. Cl.
CPC ..... *B41J 2/3351* (2013.01); *B41J 2/3352* (2013.01); *B41J 2/3354* (2013.01); *B41J 2/3357* (2013.01);

(Continued)

(58) Field of Classification Search
CPC .. B41J 2/3351; B41J 2/33515; B41J 2/33535; B41J 2/3354; B41J 2/3352; B41J 2/3357; B41J 2/33595; B41J 2/345
See application file for complete search history.

(56) References Cited

U.S. PATENT DOCUMENTS 4,841,120 A * 6/1989 Yagino ..... B41J 2/3357 219/543
5,278,580 A * 1/1994 Nishikawa ..... B41J 2/3353 347/114

(Continued)

FOREIGN PATENT DOCUMENTS

JP 2001-113741 A 4/2001
WO 2015/098423 A1 7/2015

OTHER PUBLICATIONS

International Search Report (Form PCT/ISA/210) issued for PCT/JP2015/073638, dated Nov. 17, 2015.

(Continued)

*Primary Examiner* — Ahn T. N. Vo
(74) *Attorney, Agent, or Firm* — Volpe and Koenig, P.C.

(57) ABSTRACT

A thermal head includes a substrate; a plurality of heating elements disposed on the substrate; a plurality of electrodes disposed on the substrate and electrically connected to the plurality of heating elements; a connector disposed adjacent to the substrate and including a plurality of connector pins including connection portions, each of which is electrically connected to a corresponding one of the plurality of electrodes, and a housing containing the plurality of connector pins; and a covering member covering the connection portions on the substrate. The housing includes an opening facing away from the substrate. The covering member includes a first portion located on the substrate and a second portion located on the housing. The second portion includes (Continued)

a first protrusion protruding toward the opening in a plan view.

15 Claims, 14 Drawing Sheets

(52) U.S. Cl.
CPC ..... *B41J 2/33515* (2013.01); *B41J 2/33535* (2013.01); *B41J 2/33595* (2013.01); *B41J 2/345* (2013.01)

(56) References Cited

U.S. PATENT DOCUMENTS

| | | | | |
|---|---|---|---|---|
| 5,959,651 | A * | 9/1999 | Nagahata | B41J 2/3357 347/200 |
| 6,579,125 | B1 * | 6/2003 | Nagahata | H01R 12/721 439/629 |
| 9,437,955 | B2 * | 9/2016 | Zaiser | H01R 13/52 |
| 2016/0325557 | A1 | 11/2016 | Ookubo et al. | |

OTHER PUBLICATIONS

Written Opinion (Form PCT/ISA/237) issued for PCT/JP2015/073638, dated Nov. 17, 2015.

* cited by examiner

THERMAL HEAD AND THERMAL PRINTER

TECHNICAL FIELD

The present invention relates to a thermal head and a thermal printer.

BACKGROUND ART

To date, various thermal heads have been developed as a printing device for a facsimile, a video printer, or the like. For example, a known thermal head includes a substrate; a plurality of heating elements disposed on the substrate; a plurality of electrodes disposed on the substrate and electrically connected to the plurality of heating elements; a connector including a plurality of connector pins including connection portions electrically connected to the plurality of electrodes and a housing containing the plurality of connector pins, the connector being disposed adjacent to the substrate; and a covering member covering the connection portions on the substrate (see PTL 1).

CITATION LIST

Patent Literature

PTL 1: Japanese Unexamined Patent Application Publication No. 2001-113741

SUMMARY OF INVENTION

Technical Problem

However, the connector of the thermal head may break when an external force is applied to the housing.

Solution to Problem

According to an embodiment of the present invention, a thermal head includes a substrate; a plurality of heating elements disposed on the substrate; a plurality of electrodes disposed on the substrate and electrically connected to the plurality of heating elements; a connector disposed adjacent to the substrate and including a plurality of connector pins including connection portions, each of the connection portions electrically connected to a corresponding one of the plurality of electrodes; and a housing containing the plurality of connector pins; and a covering member covering the connection portions on the substrate. The housing includes an opening facing away from the substrate. The covering member includes a first portion located on the substrate; and a second portion located on the housing. The second portion comprises a first protrusion protruding toward the opening in a plan view.

A thermal printer according to an embodiment of the present invention includes the thermal head; a transport mechanism that transports a recording medium onto the heating elements; and a platen roller that presses the recording medium against the heating elements.

Advantageous Effects of Invention

With the present invention, the probability of breakage of the connector can be reduced.

BRIEF DESCRIPTION OF DRAWINGS

FIG. 3A is a perspective view, and FIG. 3B is a partial enlarged perspective view.

FIG. 4A is a perspective view of a connector pin, FIG. 4B is a front view, and FIG. 4C is a rear view.

FIG. 5A is a plan view, and FIG. 5B is a bottom view.

FIG. 8A is a perspective view of a housing of a connector, and FIG. 8B is an enlarged plan view of a region near the connector.

FIG. 9A is a perspective view of a housing of a connector, and FIG. 9B is an enlarged plan view of a region near the connector.

FIG. 10A is a perspective view of a housing of a connector, and FIG. 10B is an enlarged plan view of a region near the connector.

FIG. 11A is a perspective view of a housing of a connector, and FIG. 11B is an enlarged plan view of a region near the connector.

FIG. 12A is a perspective view of a housing of a connector, and FIG. 12B is an enlarged plan view of a region near the connector.

FIG. 13A is an enlarged plan view of a region near a connector, FIG. 13B is a sectional view taken along line IV-IV shown in FIG. 13A.

FIG. 14A is an enlarged plan view of a region near a connector, and FIG. 14B is a further enlarged partial plan view.

DESCRIPTION OF EMBODIMENTS

First Embodiment

Figure 1:
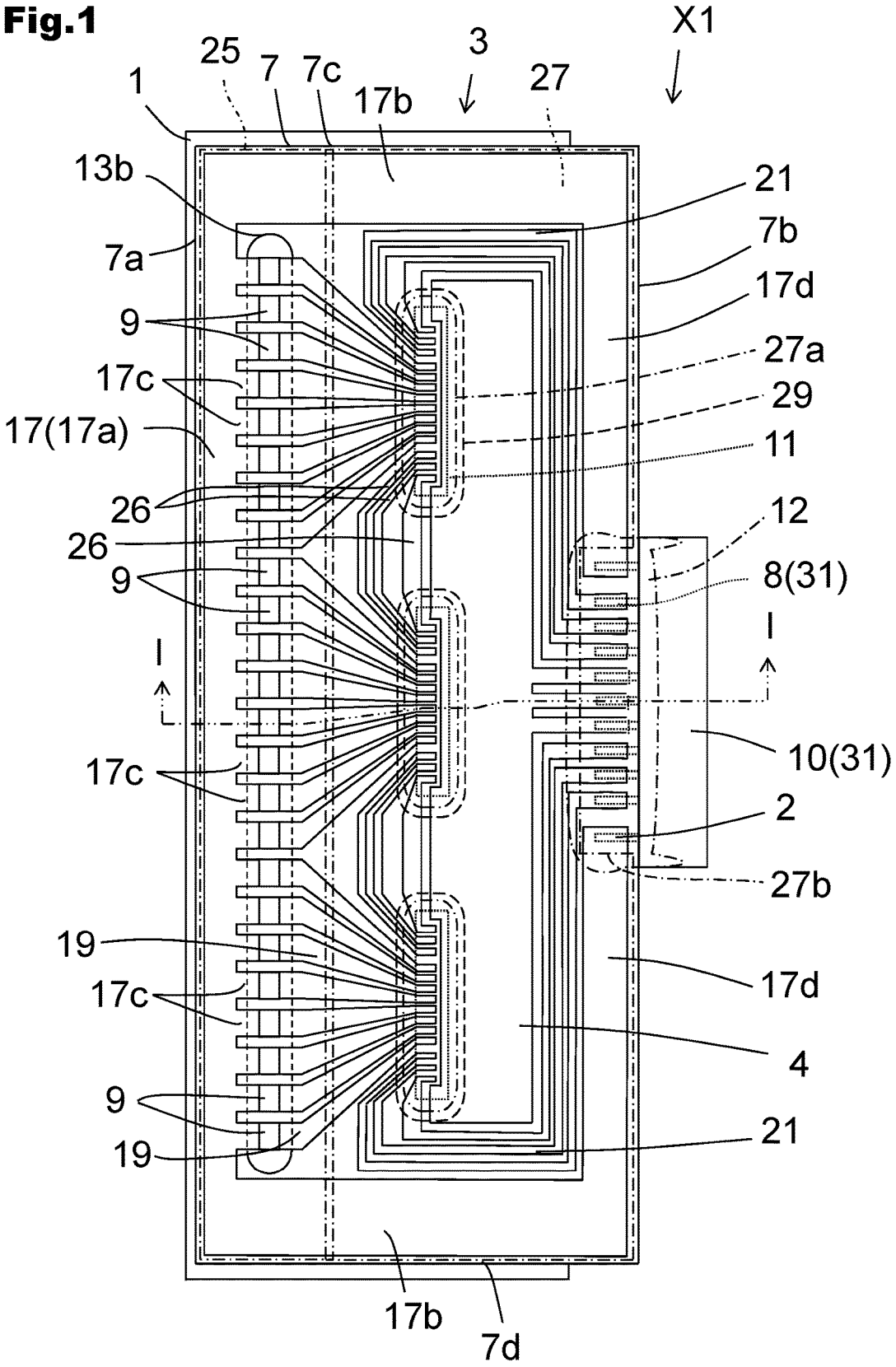
FIG. 1 is a plan view of a thermal head according to a first embodiment.

Hereinafter, a thermal head X1 will be described with reference to FIGS. 1 to 6. In FIG. 1, a protective layer 25, a covering layer 27, and a covering member 12 are omitted and shown by alternate long and short dash lines.

The thermal head X1 includes a heat sink 1, a head base body 3 disposed on the heat sink 1, and a connector 31 connected to the head base body 3.

The heat sink 1 is rectangular-parallelepiped-shaped, and a substrate 7 is placed on an upper surface of the heat sink 1. The heat sink 1 is made of, for example, a metal material, such as copper, iron, or aluminum. The heat sink 1 has a function of dissipating a part of heat that is generated by heating elements 9 of the head base body 3 and that does not contribute to printing. The head base body 3 is affixed to the upper surface of the heat sink 1 by using double-sided tape, an adhesive, or the like (not shown).

The head base body 3 is rectangular in a plan view. Components of the thermal head X1 are disposed on the substrate 7 of the head base body 3. The head base body 3 has a function of performing printing on a recording medium (not shown) in accordance with an electric signal supplied from the outside.

Figure 2:
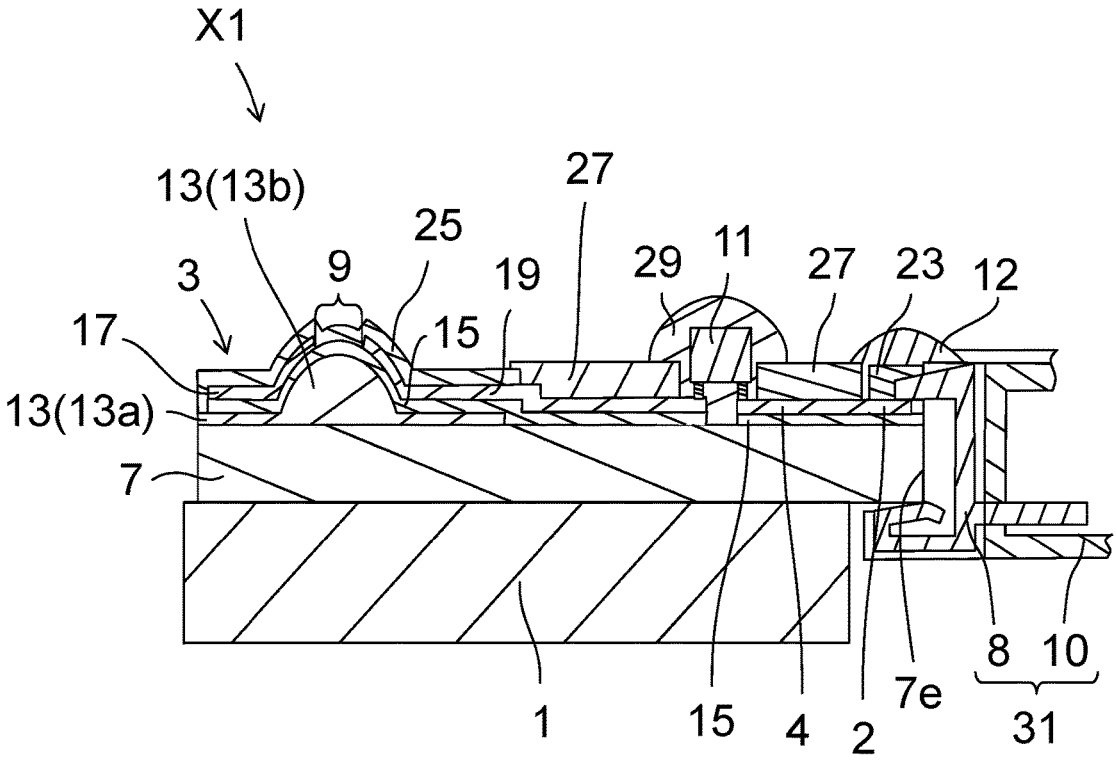
FIG. 2 is a sectional view taken along line I-I shown in FIG. 1.
Figure 3A:
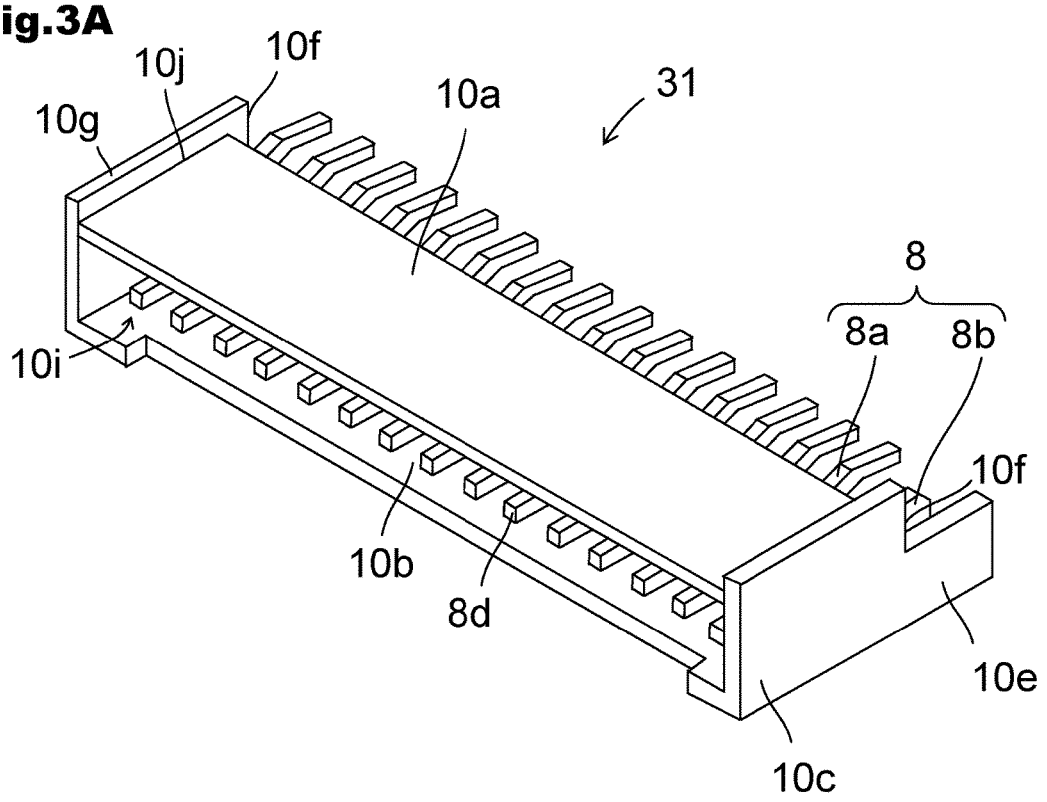
FIGS. 3A and 3B illustrate a connector of the thermal head according to the first embodiment.
Figure 3B:
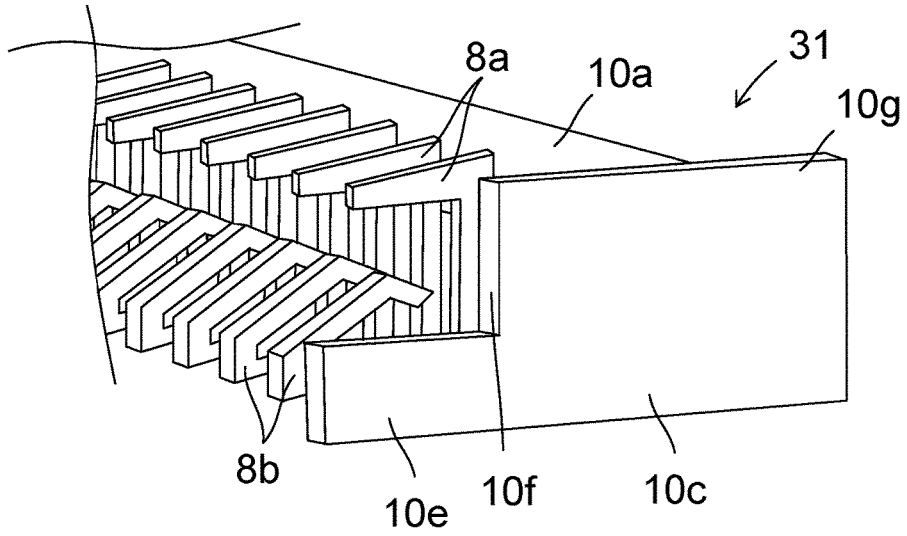
Figure 4A:
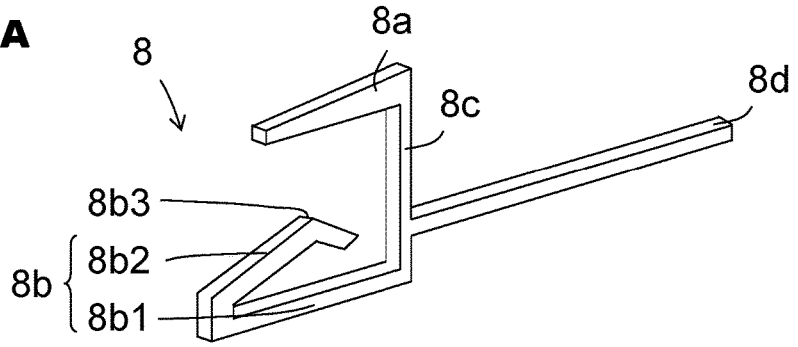
FIGS. 4A, 4B and 4C illustrate the connector of the thermal head according to the first embodiment.
Figure 4B:
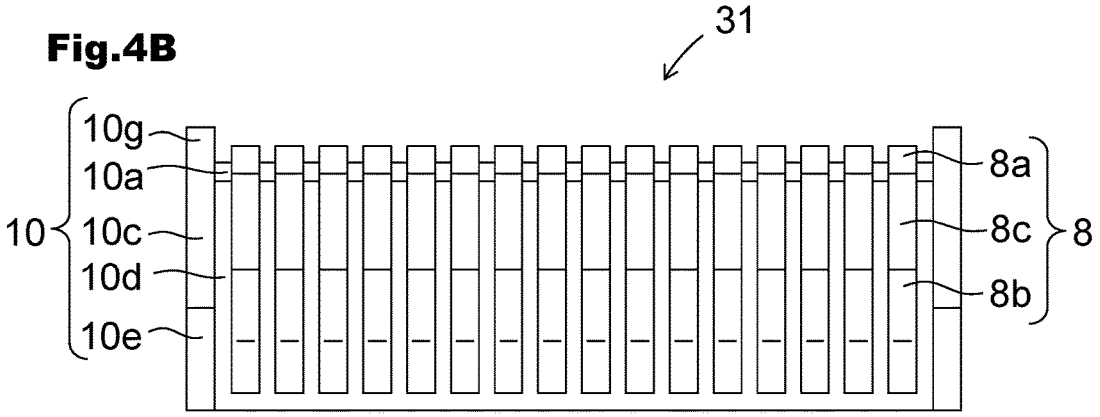
Figure 4C:
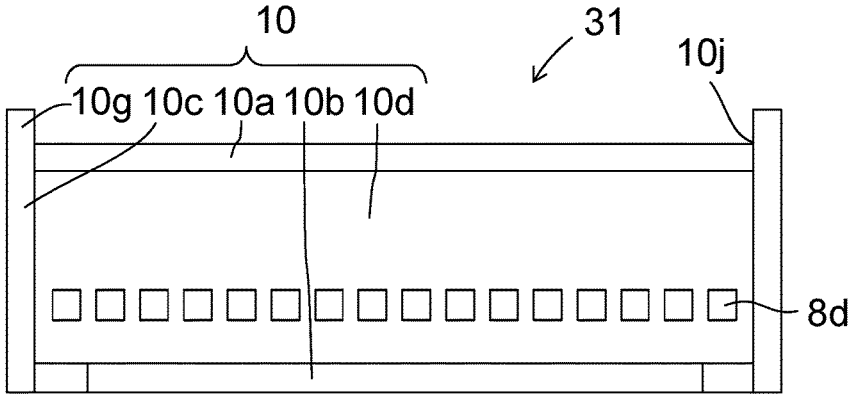

As illustrated in FIG. 2, the connector 31 includes a plurality of connector pins 8 and a housing 10 that contains the plurality of connector pins 8. One part of each of the plurality of connector pins 8 is exposed to the outside of the housing 10, and the other part of each of the plurality of connector pins 8 is contained in the housing 10. The plurality of connector pins 8 have a function of electrically connecting various electrodes of the head base body 3 to a power source, which is disposed outside. The plurality of connector pins 8 are electrically insulated from each other.

Hereinafter, the components of the head base body 3 will be described.

The substrate 7 is disposed on the heat sink 1 and is rectangular in a plan view. Therefore, the substrate 7 has one long side 7*a*, the other long side 7*b*, one short side 7*c*, and the other short side 7*d*. The substrate 7 has a side surface 7*e* near the other long side 7*b*. The substrate 7 is made of, for example, an electrically insulating material, such as alumina ceramics, or a semiconductor material, such as single-crystal silicon.

A heat storage layer 13 is formed on an upper surface of the substrate 7. The heat storage layer 13 includes a base portion 13*a* and a bulging portion 13*b*. The base portion 13*a* is formed on the left half of the upper surface of the substrate 7. The base portion 13*a* is disposed near the heating elements 9 and below the protective layer 25 described below. The bulging portion 13*b* extends in a direction in which the plurality of heating elements 9 are arranged and has a substantially semielliptical cross section. The bulging portion 13*b* functions to appropriately press a recording medium P (see FIG. 7), on which printing is performed, against the protective layer 25 on the heating elements 9.

The heat storage layer 13, which is made of glass having low heat conductivity, temporarily stores a part of heat generated by the heating elements 9. Therefore, the time needed to increase the temperature of the heating elements 9 can be reduced, and the thermal response characteristic of the thermal head X1 can be improved. For example, the heat storage layer 13 can be formed by making a predetermined glass paste by mixing glass powder and an appropriate organic solvent, applying the glass paste to the upper surface of the substrate 7 by using a known method, such as screen printing, and firing the glass paste.

A part of a resistor layer 15 is disposed on an upper surface of the heat storage layer 13, and the remaining part of the resistor layer 15 is disposed on the upper surface of the substrate 7. A ground electrode 4, a common electrode 17, individual electrodes 19, IC-connector connection electrodes 21, and IC-IC connection electrodes 26 are disposed on the resistor layer 15. The resistor layer 15 is patterned in the same shapes as the ground electrode 4, the common electrode 17, the individual electrodes 19, the IC-connector connection electrodes 21, and the IC-IC connection electrodes 26. The resistor layer 15 includes exposed regions, which are exposed, between the common electrode 17 and the individual electrodes 19. As illustrated in FIG. 1, the exposed regions of the resistor layer 15 are arranged in a row on the bulging portion 13*b* of the heat storage layer 13. The exposed regions constitute the heating elements 9. The term "main scanning direction" refers to a direction in which the plurality of heating elements 9 are arranged, and term "sub-scanning direction" refers to a direction perpendicular to the main scanning direction.

The plurality of heating elements 9, although illustrated in a simplified way in FIG. 1 for convenience of description, are arranged, for example, with a density of 100 dpi to 2400 dpi (dot per inch). The resistor layer 15 is made of a material having a comparatively high resistance, such as a TaN-based material, a TaSiO-based material, a TaSiNO-based material, a TiSiO-based material, TiSiCO-based material, or a NbSiO-based material. Therefore, when a voltage is applied to the heating elements 9, the heating elements 9 generate heat by Joule heating.

As illustrated in FIGS. 1 and 2, the ground electrode 4, the common electrode 17, the plurality of individual electrodes 19, the IC-connector connection electrodes 21, and the IC-IC connection electrodes 26 are disposed on an upper surface of the resistor layer 15. The ground electrode 4, the common electrode 17, the individual electrodes 19, the IC-connector connection electrodes 21, and the IC-IC connection electrodes 26 are made of an electroconductive material, such as a metal that is aluminum, gold, silver, or copper, or an alloy of these metals.

The common electrode 17 includes main wiring portions 17*a* and 17*d*, sub-wiring portions 17*b*, and lead portions 17*c*. The main wiring portion 17*a* extends along the one long side 7*a* of the substrate 7. The sub-wiring portions 17*b* extend respectively along the one short side 7*c* and the other short side 7*d* of the substrate 7. The lead portions 17*c* individually extend from the main wiring portion 17*a* toward the heating elements 9. The main wiring portion 17*d* extends along the other long side 7*b* of the substrate 7.

The common electrode 17 electrically connects the plurality of heating elements 9 to the connector 31. To reduce the resistance of the main wiring portion 17*a*, the main wiring portion 17*a* may be a thick electrode portion (not shown) that is thicker than the other portions of the common electrode 17. In this case, the electric capacity of the main wiring portion 17*a* can be increased.

The plurality of individual electrodes 19 electrically connect the heating elements 9 to drive ICs 11. The individual electrodes 19 divide the plurality of heating elements 9 into a plurality of groups and electrically connect the heating elements 9 of each group to a corresponding one of the drive ICs 11.

The plurality of IC-connector connection electrodes 21 electrically connect the drive ICs 11 to the connector 31. The plurality of IC-connector connection electrodes 21, which are connected to the drive ICs 11, include a plurality of wires having different functions.

The ground electrode 4 is disposed so as to be surrounded by the individual electrodes 19, the IC-connector connection electrodes 21, and the main wiring portions 17*d* of the common electrode 17, and has a large area. The ground electrode 4 has a ground electric potential in the range of 0 to 1 V.

Connection terminals 2 are disposed near the other long side 7*b* of the substrate 7 so as to connect the common electrode 17, the individual electrodes 19, the IC-connector connection electrodes 21, and the ground electrode 4 to the connector 31. The connection terminals 2 correspond to the connector pins 8. When connecting the connection terminals 2 to the connector 31, the connector pins 8 and the connection terminals 2 are connected to each other via connection portions 32 (see FIG. 6) in such a way that the connection terminals 2 are electrically insulated from each other.

The plurality of IC-IC connection electrodes 26 electrically connect the adjacent drive ICs 11. The plurality of IC-IC connection electrodes 26 correspond to the IC-connector connection electrodes 21 and transmit various signals to the adjacent drive ICs 11.

The resistor layer 15, the common electrode 17, the individual electrodes 19, the ground electrode 4, the IC-connector connection electrodes 21, and the IC-IC connection electrodes 26 are formed by, for example, successively forming material layers of each of these on the heat storage layer 13 by using a known thin-film forming technology, such as sputtering, and then patterning the stacked body in a predetermined pattern by using a known photoetching method or the like. The common electrode 17, the individual electrodes 19, the ground electrode 4, the IC-connector connection electrodes 21, and the IC-IC connection electrodes 26 can be simultaneously formed through the same process.

As illustrated in FIG. 1, the drive ICs 11 are disposed so as to correspond to the groups of the plurality of heating elements 9. Each of the drive ICs 11 is connected to the other end portion of each of the individual electrodes 19 and one end portion of each of the IC-connector connection electrodes 21. The drive IC 11 has a function of controlling energization of the heating elements 9. A switching member, which is an integrated circuit or the like including a plurality of switching devices, may be used as the drive IC 11.

Each of the drive ICs 11 is sealed with a hard coating 29, which is made of a resin such as epoxy resin or silicone resin, in a state in which the drive IC 11 is connected to the individual electrodes 19, the IC-IC connection electrodes 26, and the IC-connector connection electrodes 21.

As illustrated in FIGS. 1 and 2, the protective layer 25, which covers the heating elements 9, a part of the common electrode 17, and parts of the individual electrodes 19, is formed on the heat storage layer 13.

The protective layer 25 protects covered regions of the heating elements 9, the common electrode 17, and the individual electrodes 19 from corrosion due to adhesion of water or the like contained in air or from wear due to contact with a recording medium on which printing is performed. The protective layer 25 may be made of SiN, SiO2, SiON, SiC, diamond-like carbon, or the like. The protective layer 25 may have only one layer or may have a stack of layers. The protective layer 25 can be formed by using a thin-film forming technology, such as sputtering, or a thick film forming technology, such as screen printing.

As illustrated in FIGS. 1 and 2, the covering layer 27, which partially covers the common electrode 17, the individual electrodes 19, and the IC-connector connection electrodes 21, is disposed on the substrate 7. For convenience of description, a region in which the covering layer 27 is formed is shown by an alternate long and short dash line in FIG. 1. The covering layer 27 protects the covered regions of the common electrode 17, the individual electrodes 19, the IC-IC connection electrodes 26, and the IC-connector connection electrodes 21 from oxidation due to contact with air or from corrosion due to adhesion of water or the like contained in air.

In order to more reliably protect the common electrode 17 and the individual electrodes 19, preferably, the covering layer 27 is formed so as to overlap an end portion of the protective layer 25 as illustrated in FIG. 2. The covering layer 27 can be formed, for example, from a resin material such as an epoxy resin, a polyimide resin, or the like, by using a thick-film-forming technology, such as screen printing.

The covering layer 27 has openings 27*a* for exposing the individual electrodes 19, the IC-IC connection electrodes 26, and the IC-connector connection electrodes 21, which are connected to the drive ICs 11. These wires, which are exposed from the opening 27*a*, are connected to the drive ICs 11. The covering layer 27 has an opening 27*b*, for exposing the connection terminals 2, near the other long side 7*b* of the substrate 7. The connection terminals 2, which are exposed from the opening 27*b*, are electrically connected to the connector pins 8.

The connector 31 and the head base body 3 are fixed to each other via the connector pins 8, a joining material 23, and the covering member 12. As illustrated in FIGS. 1 and 2, the connector pins 8 are disposed on the connection terminals 2 of the ground electrode 4 and the connection terminals 2 of the IC-connector connection electrodes 21. As illustrated in FIG. 2, the connection terminals 2 and the connector pins 8 are connected to each other via the joining material 23.

Examples of the joining material 23 include a solder and an anisotropic conductive adhesive in which electroconductive particles are mixed in an electrically insulating resin. In the present embodiment, a solder is used. The connector pins 8 are covered by the joining material 23 and thereby electrically connected to the connection terminals 2. A plating layer (not shown), which is made of Ni, Au, or Pd, may be formed between the joining material 23 and the connection terminals 2. The joining material 23 may be omitted.

Hereinafter, referring to FIGS. 3 to 6, the connector 31 and the covering member 12 will be described in detail.

The connector 31 includes the plurality of connector pins 8 and the housing 10, which contains the plurality of connector pins 8. The connector 31 is disposed adjacent to the substrate 7.

Each of the connector pins 8 includes an upper connector pin 8*a*, a lower connector pin 8*b*, a link portion 8*c*, and a lead portion 8*d*, which are integrally formed. In each of the connector pins 8, the upper connector pin 8*a* and the lower connector pin 8*b* are connected to each other through the link portion 8*c*, and the lead portion 8*d* extends from the link portion 8*c*. The plurality of connector pins 8 are arranged in the main scanning direction with spaces therebetween. The connector pins 8 are separated from each other, and adjacent connector pins 8 are electrically insulated from each other.

The upper connector pins 8*a* are disposed on the connection terminals 2 (see FIG. 1) and electrically connected to the connection terminals 2 at the connection portions 32. The lower connector pins 8*b* are disposed below the substrate 7 of the head base body 3. The upper connector pins 8*a* and the lower connector pins 8*b* hold the substrate 3 therebetween. The link portions 8*c* are connected to the upper connector pins 8*a* and the lower connector pins 8*b* and extend in the thickness direction of the substrate 7. The lead portions 8*d* extend in a direction away from the head base body 3 and are joined to the housing 10. The connector 31 and the head base body 3 are electrically and mechanically joined to each other as the head base body 3 is inserted into a space between the upper connector pins 8*a* and the lower connector pins 8*b*.

Each of the lower connector pins 8*b* includes a first portion 8*b*1 and a second portion 8*b*2. The first portion 8*b*1 extends in a direction away from the link portion 8*c*. The second portion 8*b*2 is continuous with the first portion 8*b*1 and extends toward the link portion 8*c* at an angle with respect to the first portion 8*b*1. The second portion 8*b*2 includes a contact portion 8b3, and the contact portion 8b3 is in contact with the substrate 7.

The link portion 8c links the upper connector pin 8a and the lower connector pin 8b and extends in the thickness direction of the substrate 7. The lead portion 8d is connected to the link portion 8c. By connecting a cable (not shown) to the lead portion 8d from the outside, a voltage is supplied to the thermal head X1.

The housing 10 has a box shape and contains the connector pins 8 in an electrically insulated state. The housing 10 has an opening 10i facing away from the substrate 7. A socket, to which cables are connected from the outside, is inserted into the opening 10i of the housing 10. By connecting or disconnecting the cables or the like, which are disposed outside, electricity is supplied to the head base body 3.

The housing 10 includes an upper wall 10a, a lower wall 10b, side walls 10c, a front wall 10d, extension portions 10e, positioning portions 10f, and projections 10g. The opening 10i of the housing 10 is defined by the upper wall 10a, the lower wall 10b, the side walls 10c, and the front wall 10d.

The extension portions 10e extend from the side walls 10c toward positions below the substrate 7. The extension portions 10e and the substrate 7 are disposed so as to be separated from each other. The extension portions 10e extend further than the connector pins 8 from the housing 10.

The positioning portions 10f have a function of positioning the head base body 3 that is inserted. The positioning portions 10f are disposed closer than the link portions 8c of the connector pins 8 to the substrate 7. Because the housing 10 includes the positioning portions 10f, the head base body 3 is not abutted against the link portions 8c of the connector pins 8. Therefore, the probability of the connector pins 8 becoming, for example, bent and broken can be reduced.

The projections 10g protrude from the upper wall 10a and extend in the sub-scanning direction. Corners 10j are defined by the projections 10g and the upper wall 10a. The projections 10g have a function of protecting the upper connector pins 8a. Upper ends of the projections 10g are located above the upper ends of the upper connector pins 8a. Thus, when the recording medium P (see FIG. 7) or the like contacts the housing 10, the projections 10g contact the recording medium P or the like, and thereby the probability of the upper connector pins 8a contacting the recording medium P or the like can be reduced. The projections 10g are disposed at both ends of the upper wall 10a of the housing 10 in the main scanning direction.

The lead portions 8d of the connector pins 8 are embedded in the front wall 10d of the housing 10, and the connector pins 8 are joined to the housing 10. Therefore, the lower connector pins 8b can deform around the lead portions 8d. As a result, the first portions 8b1 of the lower connector pins 8b and the link portions 8c, which connect the first portions 8b1 to the lead portions 8d, can deform, so that insertion of the substrate 7 can be efficiently performed.

The covering member 12 covers the connection portions 32 of the upper connector pins 8a on the substrate 7. The covering member 12 includes a first portion 12a and a second portion 12b. The first portion 12a is a portion of the covering member 12 that is disposed the substrate 7 and expends in the main scanning direction. The second portion 12b is a portion of the covering member 12 that is disposed on the connector 31 and extends in the main scanning direction. In plan view, the second portion 12b includes first protrusions 12b1.

The first protrusions 12b1 are disposed on the upper wall 10a of the housing 10 and protrude from the upper wall 10a on the front wall 10d in the sub-scanning direction toward the opening 10i of the housing 10. The first protrusions 12b1 protrude from the second portion 12b on the front wall 10d toward the opening 10i of the housing 10 by about 0.5 to 2 mm.

Electrical connection between the thermal head X1 and the outside is performed by inserting a socket into or extracting the socket from the opening 10i of the housing 10. When inserting the socket into the housing 10 or when extracting the socket from the housing 10, an external force may be applied to the housing 10. When an external force is applied to the housing 10, breakage, such as a crack, may occur in a portion of the housing 10 near the opening 10i.

To prevent this, the second portion 12b includes the first protrusions 12b1, which protrude toward the opening 10i of the housing 10. Therefore, the first protrusions 12b1 are disposed on portions of the housing 10 near the opening 10i, and the covering member 12 is disposed on the portions of the housing 10 near the opening 10i. Thus, the covering member 12 can reinforce the portions of the housing 10 near the opening 10i. As a result, even when an external force is applied to the housing 10, the probability of breakage of the housing 10 can be reduced.

Figure 5A:
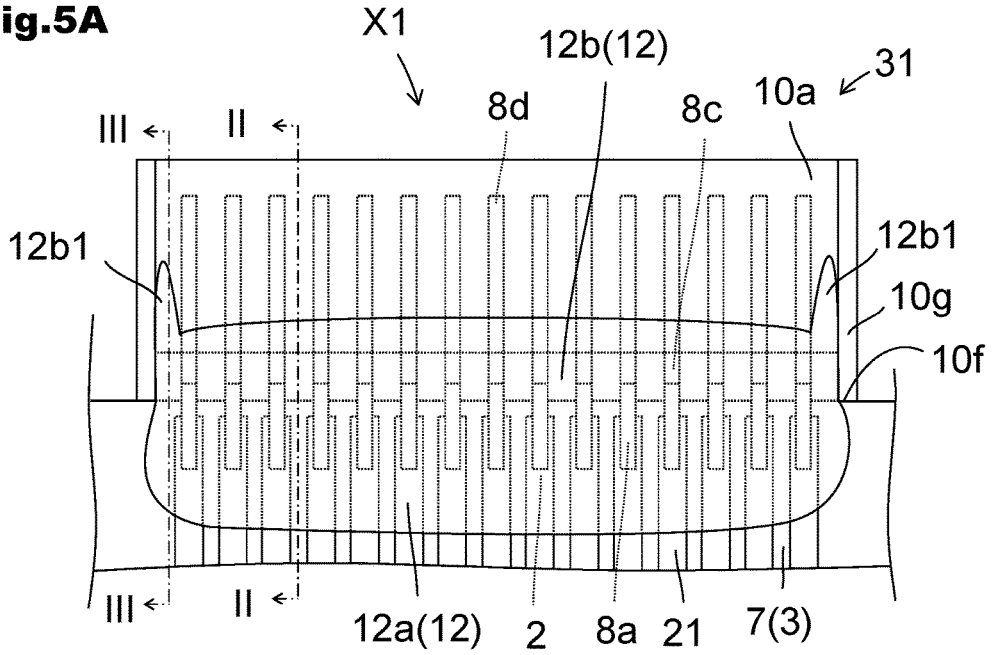
FIGS. 5A and 5B show enlarged views of a region near the connector of the thermal head according to the first embodiment.
Figure 5B:
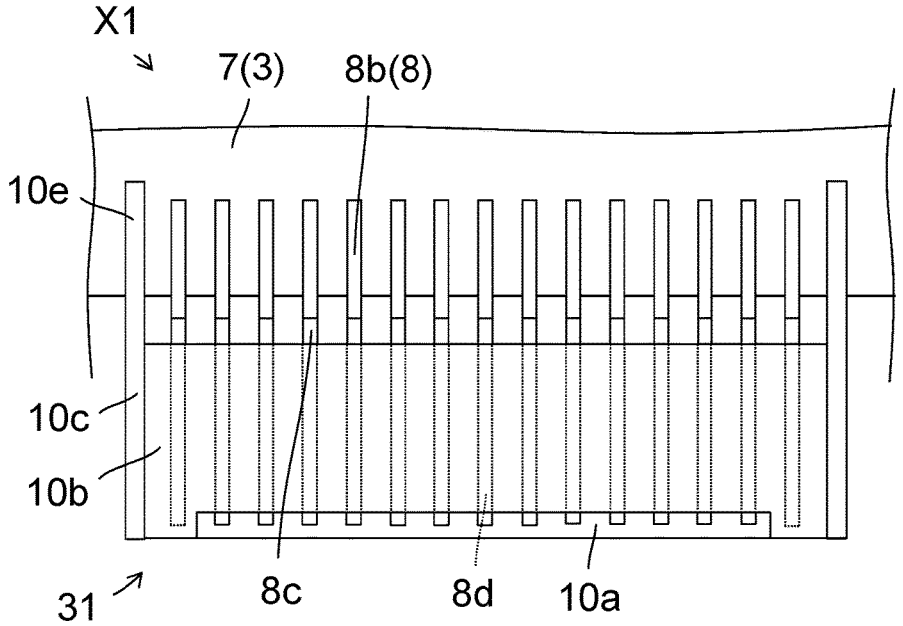
Figure 6A:
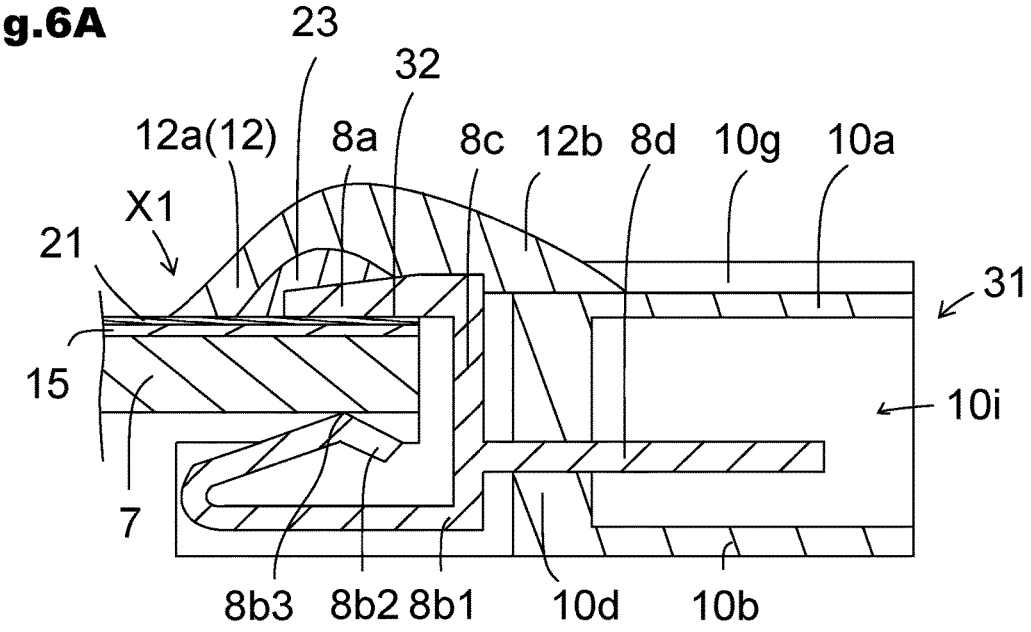
FIG. 6A is a sectional view taken along line II-II shown in FIG. 5A.
Figure 6B:
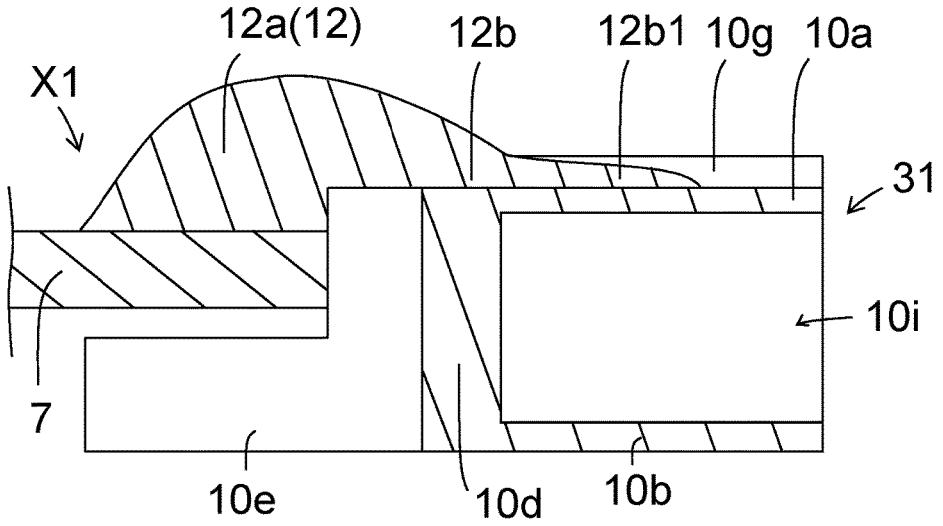
FIG. 6B is a sectional view taken along line III-III shown in FIG. 5A.

When extracting the socket from the housing 10, a large external force in the left-right direction (main scanning direction) in FIG. 5A may be applied to the housing 10. Therefore, cracks may develop from both end portions of the housing 10 in the main scanning direction, and the housing 10 may break.

To prevent this, the first protrusions 12b1 are disposed at both ends of the upper wall 10a in the main scanning direction. Therefore, the first protrusions 12b1 can reinforce both end portions of the housing 10 in the main scanning direction. Thus, it is possible to reduce the probability of occurrence of cracks in both end portions of the housing 10 in the main scanning direction and to reduce the probability of breakage of the housing 10.

The projections 10g, which protrude from the upper wall 10a, may contact the recording medium or the like. When the projections 10g contact the recording medium P or the like, stresses are generated at the corners 10j, which are defined by the projection 10g and the upper wall 10a, and cracks may occur in the corners 10j. When cracks occur in the corner 10j, the cracks in the corners 10j may develop and the housing 10 may break.

To prevent this, the housing 10 includes the projections 10g, which are disposed at both end portions of the upper wall 10a in the main scanning direction, protrude from the upper wall 10a, and extend in the sub-scanning direction. The first protrusions 12b1 are disposed at the corners 10j, which are defined by the projections 10g and the upper wall 10a.

Because the first protrusions 12b1 are disposed at the corners 10j, the corners 10j are reinforced by the covering member 12, and the probability of occurrence of cracks in the corners 10j can be reduced. Therefore, the probability of breakage of the housing 10 can be reduced.

Because the projections 10g protrude from the upper wall 10a and extend in the sub-scanning direction, the covering member 12 flows along the projections 10g, and the first protrusions 12b1 can be formed so as to extend toward the opening 10i of the housing 10.

The covering member 12 is disposed so that the connection terminals 2 and the upper connector pins 8a are not exposed to the outside. The covering member 12 may be made of, for example, an epoxy thermosetting resin, a UV curable resin, or a visible-light curable resin.

Hereinafter, how the components of the thermal head X1 are joined will be described.

First, in order to join the substrate 7, on which the components of the head base body 3 are formed, to the connector 31, the substrate 7 is inserted into a space between the upper connector pins 8*a* and the lower connector pins 8*b*. Next, the joining material 23 is applied to the upper connector pins 8*a* by printing and is caused to reflow. Thus, the connector 31 and the substrate 7 are electrically and mechanically joined to each other.

Next, the covering member 12 is applied so as to cover the upper connector pins 8*a* and the connection terminals 2. The covering member 12 is applied over the substrate 7 and the upper wall 10*a* of the housing 10 so that the upper connector pins 8*a* and the connection terminals 2 are not exposed. The first protrusions 12*b*1 are formed by applying the covering member 12 so that the first portion 12*a* protrudes in a direction away from the heating elements 9.

If the covering member 12 is made of a thermosetting resin, the thermal head X1 can be made by curing the covering member 12 with heat and by placing the head base body 3, on which the covering member 12 is disposed, on the heat sink 1 on which double-sided tape or the like is disposed. Alternatively, the covering member 12 may be cured after placing the head base body 3, on which the covering member 12 is disposed, on the heat sink 1 on which double-sided tape or the like is disposed.

The first protrusions 12*b*1 need not be disposed at both end portions of the housing 10 in the main scanning direction. For example, the first protrusion 12*b*1 may be disposed at a central portion of the housing 10 in the main scanning direction. Alternatively, for example, the first protrusion 12*b*1 may be disposed at one of two end portions of the housing 10 in the main scanning direction. Also in these cases, the first protrusion 12*b*1 is disposed on a portion of the housing 10 near the opening 10*i*, and therefore the portion of the housing 10 near the opening 10*i* can be reinforced.

Next, a thermal printer Z1 will be described with reference to FIG. 7.

Figure 7:
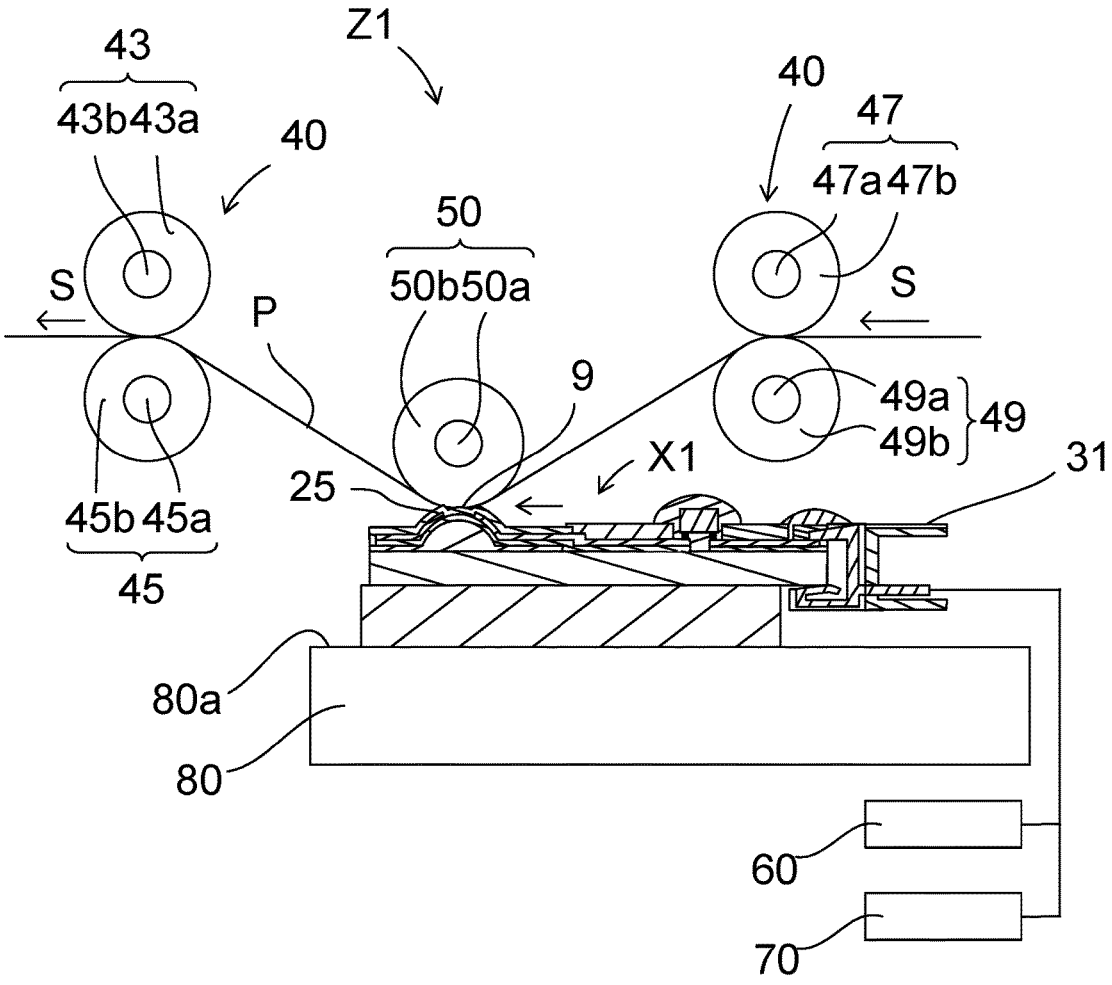
FIG. 7 is a schematic view of a thermal printer according to the first embodiment.

As illustrated in FIG. 7, the thermal printer Z1 according to the present embodiment includes the thermal head X1, a transport mechanism 40, a platen roller 50, a power supply 60, and a control device 70. The thermal head X1 is attached to an attachment surface 80*a* of an attachment member 80, which is disposed on a housing (not shown) of the thermal printer Z1. The thermal head X1 is attached to the attachment member 80 so as to extend in the main scanning direction, which is a direction perpendicular to the transport direction S of the recording medium P described below.

The transport mechanism 40 includes a drive unit (not shown) and transport rollers 43, 45, 47, and 49. The transport mechanism 40 transports a recording medium P, which is thermal paper, printing paper to which ink is transferred, or the like, in the direction of arrow S in FIG. 7 to transport the recording medium P onto the protective layer 25, which is located on the plurality of heating elements 9 of the thermal head X1. The drive unit has a function of driving the transport rollers 43, 45, 47, and 49. For example, a motor may be used as the drive unit. For example, the transport rollers 43, 45, 47, and 49 are made by covering cylindrical shafts 43*a*, 45*a*, 47*a*, and 49*a*, which are made of a metal such as a stainless steel, with elastic members 43*b*, 45*b*, 47*b*, and 49*b*, which are made of butadiene rubber or the like. Although not shown in the figure, if the recording medium P is printing paper to which ink is transferred or the like, an ink film is transported together with the recording medium P to a space between the recording medium P and the heating elements 9 of the thermal head X1.

The platen roller 50 has a function of pressing the recording medium P against the protective film 25, which is located on the heating elements 9 of the thermal head X1. The platen roller 50 is disposed so as to extend in a direction perpendicular to the transport direction S of the recording medium P. Both end portions of the platen roller 50 are supported and fixed so that the platen roller 50 can rotate while pressing the recording medium P against the heating elements 9. For example, the platen roller 50 can be made by covering a cylindrical shaft 50*a*, which is made of a metal such as a stainless steel, with an elastic member 50*b*, which is made of butadiene rubber or the like.

The power supply 60 has a function of supplying an electric current for causing the heating elements 9 of the thermal head X1 to generate heat as described above and supplying an electric current for driving the drive ICs 11. The control device 70 has a function of supplying control signals, for controlling operations of the drive ICs 11, to the drive ICs 11 to selectively cause the heating elements 9 of the thermal head X1 to generate heat.

As illustrated in FIG. 7, the thermal printer Z1 performs predetermined printing on the recording medium P by selectively causing the heating elements 9 to generate heat by using the power supply 60 and the control device 70 while transporting the recording medium P onto the heating elements 9 by using the transport mechanism 40 and pressing the recording medium P against the heating elements 9 of the thermal head X1 by using the platen roller 50. If the recording medium P is printing paper or the like, printing on the recording medium P is performed by thermally transferring ink of an ink film (not shown), which is transported together with the recording medium P, to the recording medium P.

Second Embodiment

Figure 8A:
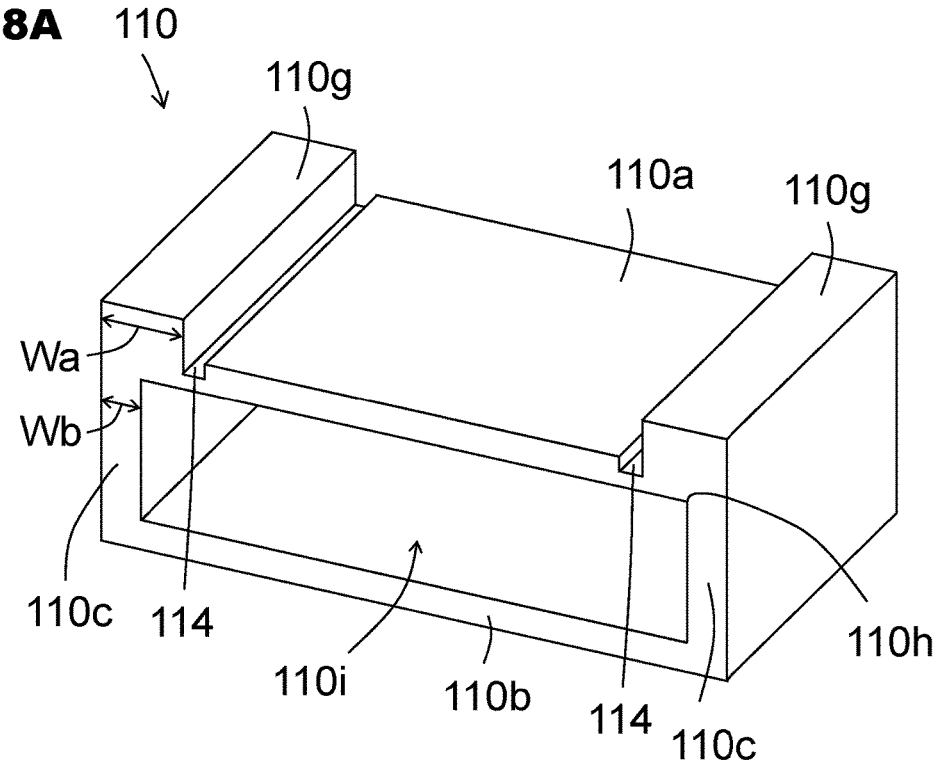
FIGS. 8A and 8B illustrate a thermal head according to a second embodiment.
Figure 8B:
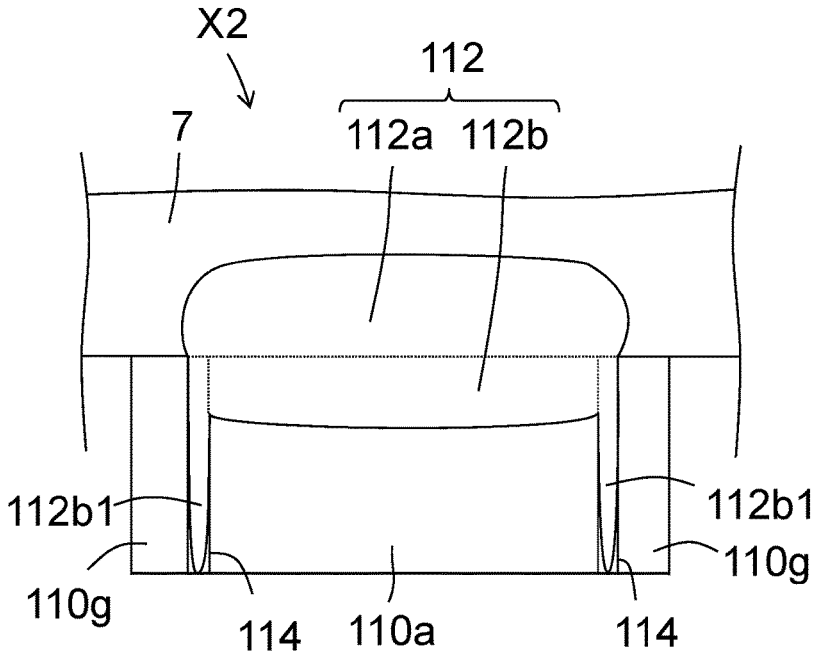

Referring to FIG. 8, a thermal head X2 will be described. The thermal head X2 differs from the thermal head X1 in the shape of a housing 110 and the shape of a covering member 112. In other respects, the thermal head X2 is the same as the thermal head X1. The same members will be denoted by the same numerals, and the same applies to the following embodiments.

The housing 110 includes an upper wall 110*a*, a lower wall 110*b*, side walls 110*c*, and a front wall (not shown); and has a box shape. The housing 110 has an opening 110*i* facing away from the substrate 7. The housing 110 includes projections 110*g*, which protrude from the upper wall 110*a* and extend in the sub-scanning direction. First grooves 114, which extend in the sub-scanning direction, are formed in the upper wall 110*a* so as to be adjacent to the projections 110*g*. The first grooves 114 extend from one end to the other end of the upper wall 110*a* in the sub-scanning direction.

The covering member 112 includes a first portion 112*a* and a second portion 112*b*. The second portion 112*b* includes first protrusions 112*b*1. The first protrusions 112*b*1 extend toward the opening 110*i* of the housing 110.

The width Wa of the projections 110*g* in the main scanning direction is greater than the width Wb of the side walls 110*c* in the main scanning direction. Therefore, the rigidity of the projections 110*g* can be increased. As a result, even when the projections 11*g* contact the recording medium P (see FIG. 7) or the like, the probability of breakage of the projections 110*g* can be reduced because the projections

110*g* have high rigidity. As a result, the probability of breakage of the housing 110 can be reduced.

By increasing the width Wa of the projections 110*g* in the main scanning direction, the rigidity of the projections 110*g* can be increased without increasing the height of the projections 110*g* in the thickness direction of the substrate 7. Thus, the probability of the recording medium P (see FIG. 7) contacting the projections 110*g* can be reduced. As a result, the probability of scratching the recording medium P can be reduced.

The first grooves 114 are formed in the upper wall 110*a* so as to be adjacent to the projections 110*g*, and the first protrusions 112*b*1 are disposed in the first grooves 114. Therefore, when the covering member 112 is applied to the upper wall 110*a* of the housing 110, the covering member 112 is disposed also in the first grooves 114. As a result, the covering member 112 flows toward the opening 110*i* of the housing 110 due to capillary action. Therefore, the length of the first protrusions 112*b*1 in the sub-scanning direction can be increased, and the housing 110 can be further reinforced.

The width Wa of the projections 110*g* in the main scanning direction may be, for example, in the range of 0.5 to 1.2 cm. The width Wb of the side walls 110*c* in the main scanning direction is, for example, in the range of 0.3 to 0.8 cm.

Preferably, the width Wa of the projections 110*g* in the main scanning direction is 1.05 to 1.5 times the width Wb of the side walls 110*c* in the main scanning direction. Thus, the rigidity of the projections 110*g* can be increased.

Corners 110*h*, which are defined by the side wall 110*c* and the upper wall 110*a*, may be chamfered. In this case, it is possible to reduce the probability of concentration of stress on the corners 110*h* and to reduce the probability of occurrence of crack in the housing 110 extending from the corners 110*h*.

Third Embodiment

Figure 9A:
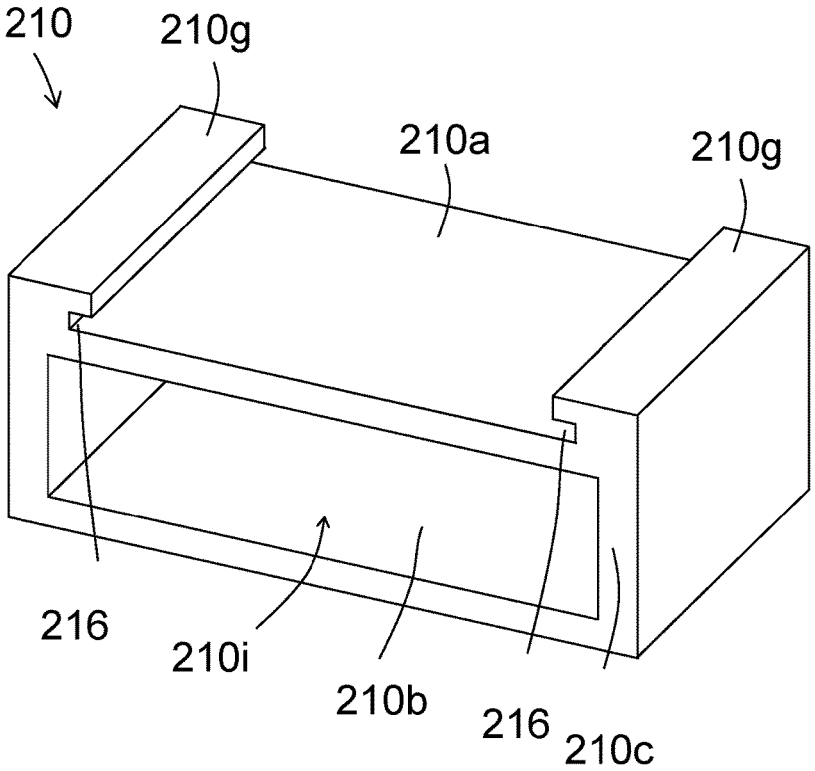
FIGS. 9A and 9B illustrate a thermal head according to a third embodiment.
Figure 9B:
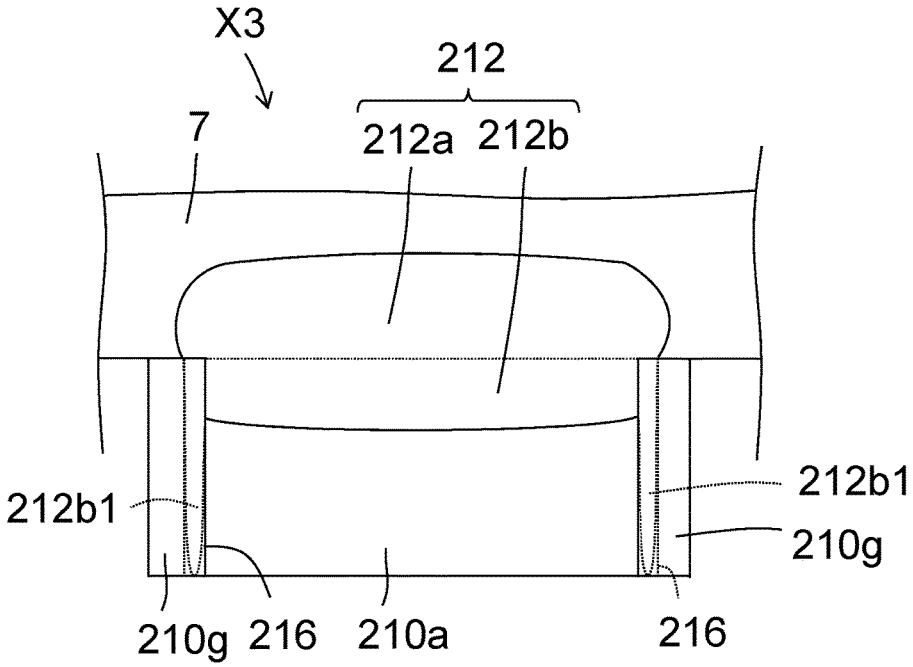

Referring to FIG. 9, a thermal head X3 will be described. The thermal head X3 differs from the thermal head X2 in the shape of a housing 210 and the shape of a covering member 212. In other respects, the thermal head X3 is the same as the thermal head X2.

The housing 210 includes an upper wall 210*a*, a lower wall 210*b*, side walls 210*c*, and a front wall (not shown); and has a box shape. The housing 210 includes projections 210*g*, which protrude from the upper wall 210*a* and extend in the sub-scanning direction. Second grooves 216, which extend in the sub-scanning direction, are formed in the projections 210*g*. The second grooves 216 extend from one end to the other end of the upper wall 210*a* in the sub-scanning direction.

The covering member 212 includes a first portion 212*a* and a second portion 212*b*. The second portion 212*b* includes first protrusions 212*b*1. The first protrusions 212*b*1 protrude toward an opening 210*i* of the housing 210 from the first portion 212*a* and extend to positions near the opening 210*i* of the housing 210. The first protrusions 212*b*1 are disposed in the second grooves 216.

The second grooves 216, which extend in the sub-scanning direction, are formed in the projections 210*g*, and the first protrusions 212*b*1 are disposed on the second grooves 216. Therefore, when the covering member 212 is applied to the upper wall 210*a* of the housing 210, the covering member 212 is disposed also in the second groove 216. As a result, the covering member 212 flows toward the opening 210*i* of the housing 210 due to capillary action. As a result, the length of the first protrusions 212*b*1 in the sub-scanning direction can be increased, and the housing 210 can be further reinforced.

In the above example, the first protrusions 212*b*1 are disposed only in the second grooves 216. However, the first protrusions 212*b*1 may overflow from the second grooves 216.

Fourth Embodiment

Figure 10A:
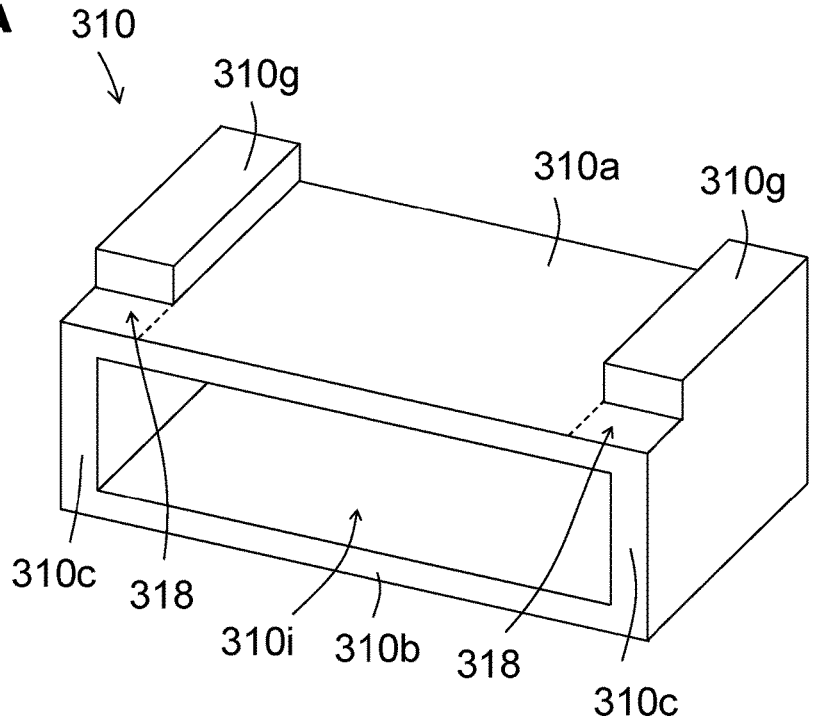
FIGS. 10A and 10B illustrate a thermal head according to a fourth embodiment.
Figure 10B:
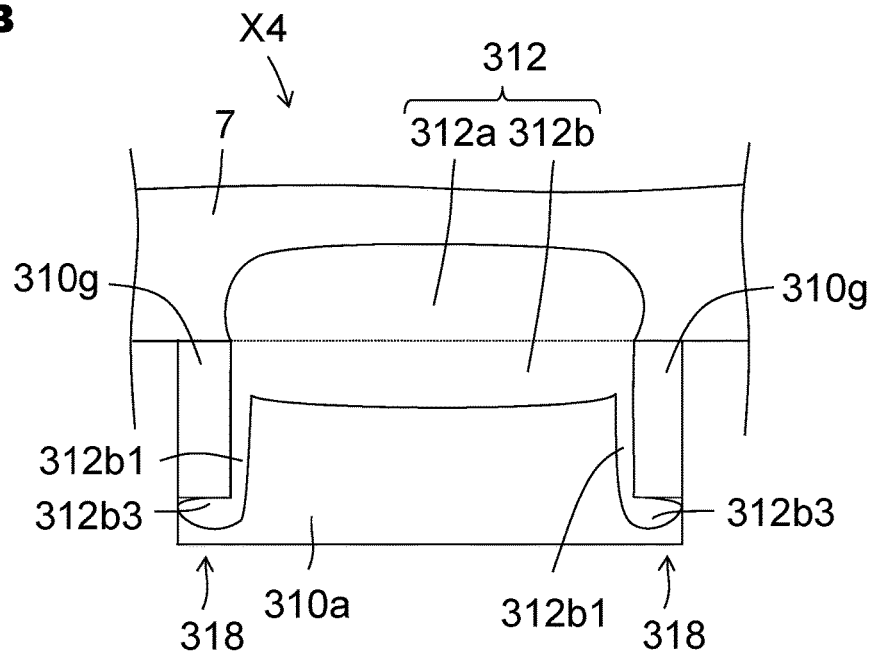

Referring to FIG. 10, a thermal head X4 will be described. The thermal head X4 differs from the thermal head X2 in the shape of a housing 310 and in the shape of a covering member 312. In other respects, the thermal head X4 is the same as the thermal head X2.

The housing 310 includes an upper wall 310*a*, a lower wall 310*b*, side walls 310*c*, and a front wall (not shown); and has a box shape. The housing 310 includes projections 310*g*, which extend in the sub-scanning direction. The projections 310*g* have cutouts 318 in portions thereof near an opening 310*i* of the housing 310. Therefore, parts of the upper wall 310*a* near the opening 310*i* of the housing 310 are exposed.

The covering member 312 includes a first portion 312*a* and a second portion 312*b*. The second portion 312*b* includes first protrusions 312*b*1, and parts of the first protrusion 312*b*1 are extension portions 312*b*3. The extension portions 312*b*3 are disposed in the cutouts 318 of the projections 310*g* and are integrally formed with the first protrusions 312*b*1. Thus, the first protrusions 312*b*1 protrude from the second portion 312*b* on the upper wall 310*a* toward the opening 310*i* of the housing 310, and then extend in the main scanning direction.

The projections 310*g* have the cutouts 318 near the opening 310*i* of the housing 310, and the extension portions 312*b*3, which are parts of the first protrusions 312*b*1, are disposed in the cutouts 318. Thus, the first protrusions 312*b*1 protrude from the second portion 312*b* on the upper wall 310*a* toward the opening 310*i* of the housing 310, and then extend in the main scanning direction.

As a result, the first protrusions 312*b*1 can be disposed near the opening 310*i* on the side walls 310*c* located at both ends of the housing 310 in the main scanning direction, and the side walls 310*c* can be reinforced by the first protrusions 312*b*1. Thus, the probability of occurrence of cracks in both end portions of the housing 310 in the main scanning direction can be reduced, and the probability of breakage of the housing 310 can be reduced.

Fifth Embodiment

Figure 11A:
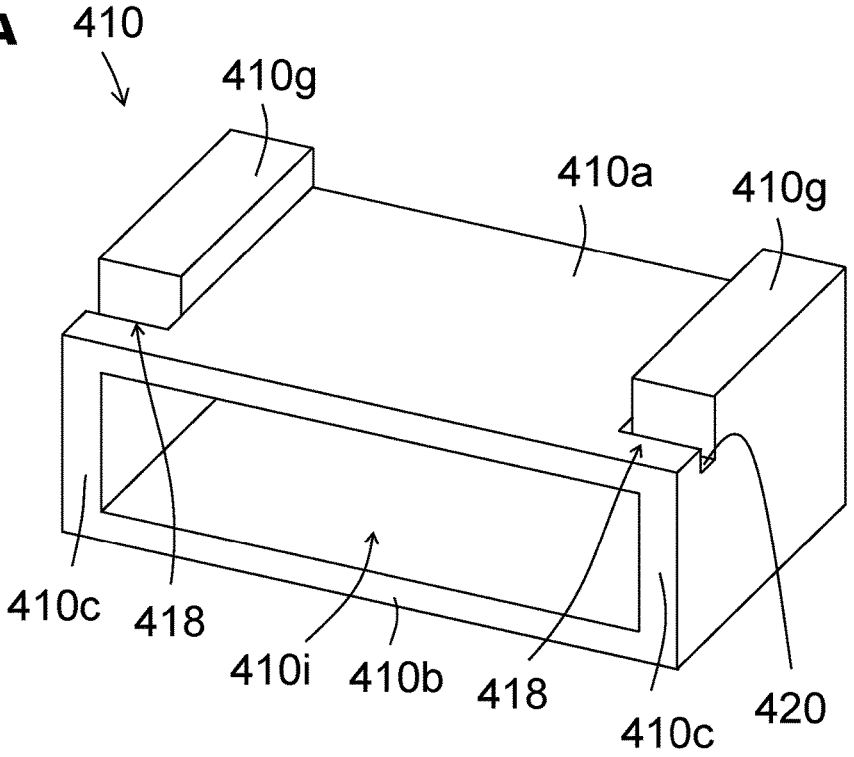
FIGS. 11A and 11B illustrate a thermal head according to a fifth embodiment.
Figure 11B:
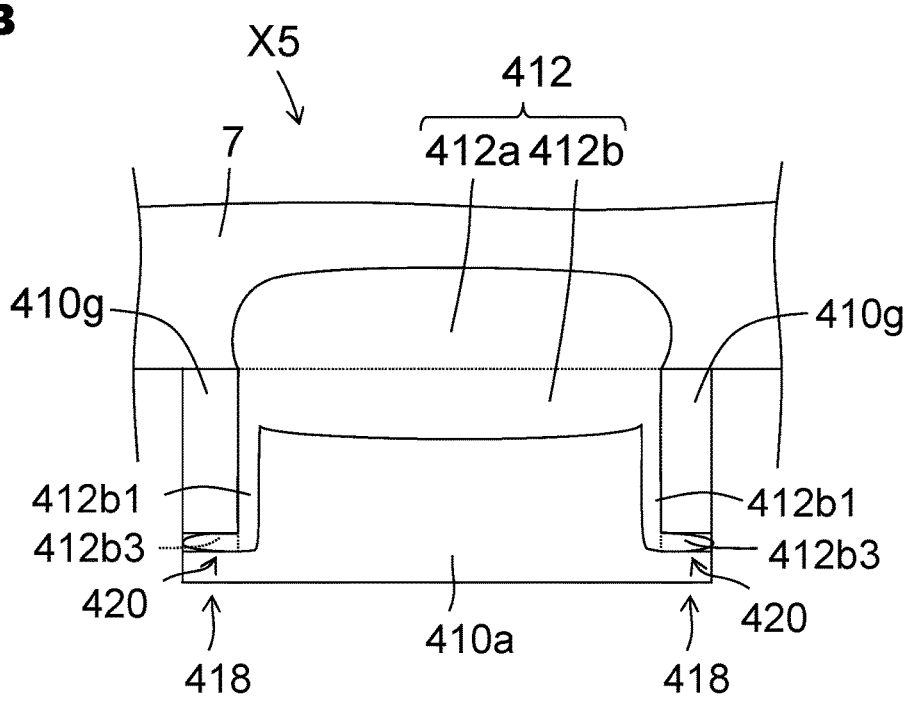

Referring to FIG. 11, a thermal head X5 will be described. The thermal head X5 differs from the thermal head X4 in the shape of a housing 410 and in the shape of a covering member 412. In other respects, the thermal head X5 is the same as the thermal head X4.

The housing 410 includes an upper wall 410*a*, a lower wall 410*b*, side walls 410*c*, and a front wall (not shown); and has a box shape. The housing 410 includes projections 410*g*, which extend in the sub-scanning direction. The projections 410*g* have cutouts 418 in parts thereof away from the substrate 7. Third grooves 420, which extend in the main scanning direction, are formed in the upper wall 410*a* corresponding to the cutouts 418. The phrase "the upper wall 410*a* corresponding to the cutouts 418" refers to parts of the upper wall 410*a* that are located below the cutouts 418.

The covering member 412 includes a first portion 412*a* and a second portion 412*b*. The second portion 412*b* includes first protrusions 412*b*1, and parts of the first protrusion 412*b*1 are extension portions 412*b*3. The extension portions 412*b*3 are disposed in the third grooves 420. Thus, the first protrusions 412*b*1 protrude from the second portion 412*b* on the upper wall 410*a* toward an opening 410*i* of the housing 410, then extend in the main scanning direction, and the extension portions 412*b*3 are contained in the third grooves 420.

The third grooves 420, which extend in the main scanning direction, are formed in the upper wall 410*a* corresponding to the cutouts 418; and the extension portions 412*b*3, which are parts of the first protrusions 412*b*1, are disposed in the third grooves 420. Therefore, the first protrusions 412*b*1, which extend to positions near the cutouts 418, flow into the third grooves 420, and the covering member 412 can be disposed near the cutouts 418. Thus, the side walls 410*c* can be reinforced by the covering member 412.

As a result, the first protrusions 412*b*1 can be disposed near the opening 410*i* on the side walls 410*c* located at both ends of the housing 410 in the main scanning direction, and the side walls 410*c* can be reinforced by the first protrusions 412*b*1. Thus, the probability of occurrence of cracks in both end portions of the housing 410 in the main scanning direction can be reduced, and the probability of breakage of the housing 410 can be reduced.

Preferably, the spaces in the third grooves 420 are filled with the extension portions 412*b*3 of the covering member 412. The extension portions 412*b*3 may overflow from the third grooves 420.

Sixth Embodiment

Figure 12A:
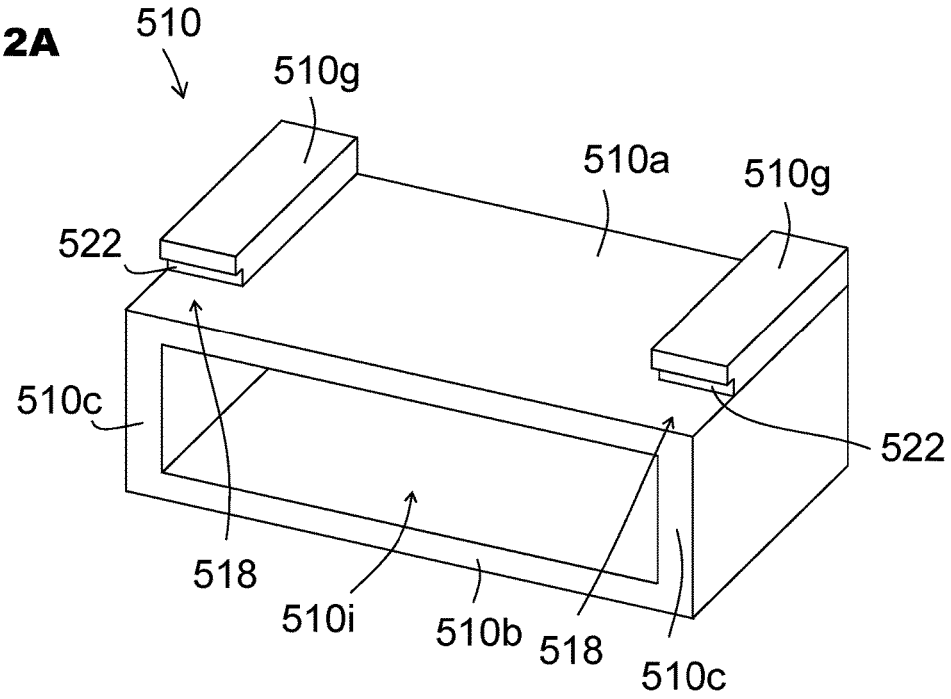
FIGS. 12A and 12B illustrate a thermal head according to a sixth embodiment.
Figure 12B:
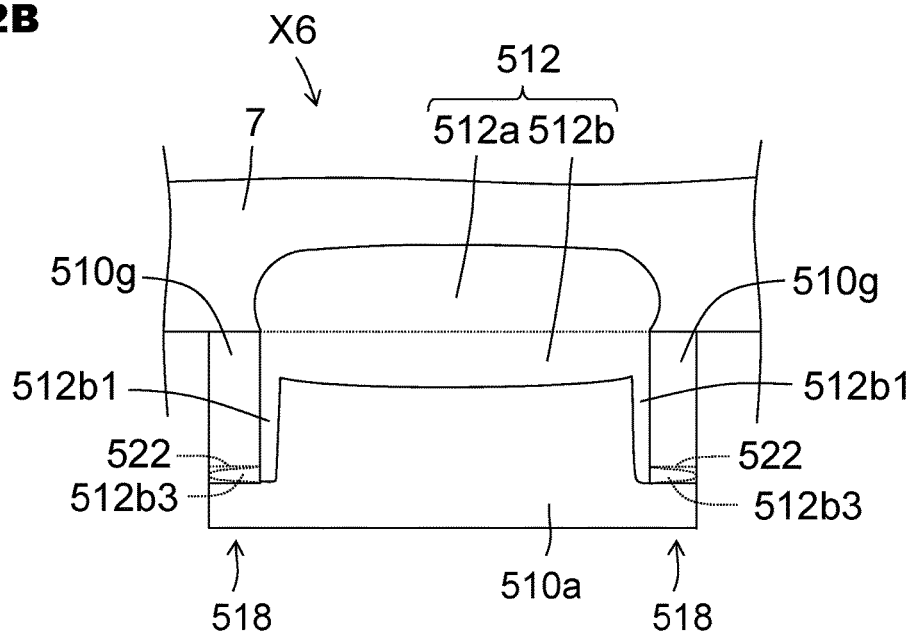

Referring to FIG. 12, a thermal head X6 will be described. The thermal head X6 differs from the thermal head X4 in the shape of a housing 510 and in the shape of a covering member 512. In other respects, the thermal head X6 is the same as the thermal head X4.

The housing 510 includes an upper wall 510*a*, a lower wall 510*b*, side walls 510*c*, and a front wall (not shown); and has a box shape. Projections 510*g*, which extend in the sub-scanning direction, are formed on the side walls 510*c*. The projections 510*g* have cutouts 518 near an opening 510*i* of the housing 510. Fourth grooves 522, which extend in the main scanning direction, are formed in the projections 510*g* adjacent to the cutouts 518.

The covering member 512 includes a first portion 512*a* and a second portion 512*b*. The second portion 512*b* includes first protrusions 512*b*1, and parts of the first protrusions 512*b*1 are extension portions 512*b*3. The extension portions 512*b*3 are disposed in the fourth grooves 522. Thus, the first protrusions 512*b*1 protrude from the second portion 512*b* on the upper wall 510*a* toward the opening 510*i* of the housing 510, then extend in the main scanning direction, and the extension portions 512*b*3 are contained in the fourth grooves 522.

The fourth grooves 522, which extend in the main scanning direction, are formed in the projections 510*g* adjacent to the cutouts 518; and the extension portions 512*b*3, which are parts of the first protrusions 512*b*1, are disposed in the fourth grooves 522. Therefore, the first protrusions 512*b*1, which have extended to positions near the cutouts 518, flow into the fourth grooves 522, and the covering member 512 can be disposed near the cutouts 518. As a result, portions near the cutouts 518 can be reinforced by the covering member 512, and the side walls 510*c* located below the base member 518 can be reinforced.

As a result, the first protrusions 512*b*1 can be disposed near the opening 510*i* on the side walls 510*c* located at both ends of the housing 510 in the main scanning direction, and the side walls 510*c* can be reinforced by the first protrusions 512*b*1. Thus, the probability of occurrence of cracks in both end portions of the housing 510 in the main scanning direction can be reduced, and the probability of breakage of the housing 510 can be reduced.

In the above structure, the thermal head X6 has only the fourth grooves 522. However, the thermal head X6 may also have the third grooves 422 (see FIG. 11) as the thermal head X5 does. In this case, the side walls 510*c* can be further reinforced by the first protrusions 512*b*1.

Seventh Embodiment

Figure 13A:
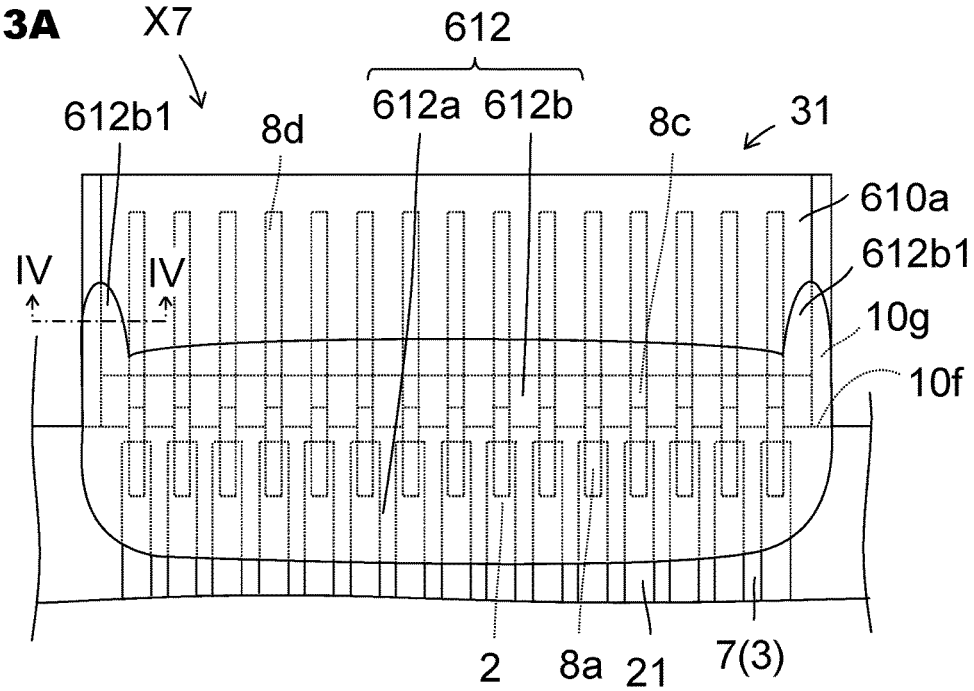
FIGS. 13A and 13B illustrate a thermal head according to a seventh embodiment.
Figure 13B:
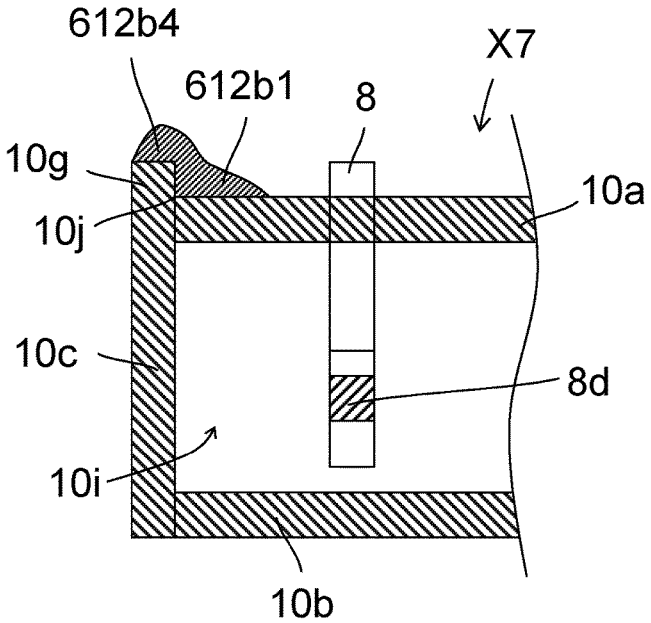

Referring to FIG. 13, a thermal head X7 will be described. The thermal head X7 differs from the thermal head X1 in the shape of a covering member 612. In other respects, the thermal head X7 is the same as the thermal head X1.

The covering member 612 includes a first portion 612*a* and a second portion 612*b*. The second portion 612*b* includes first protrusions 612*b*1. The first protrusions 612*b*1 include overlapping portions 612*b*4, which are disposed on the projections 10*g*.

The overlapping portions 612*b*4 are disposed on the projections 10*g* near the substrate 7, are disposed so as to cover parts of the projections 10*g*, and are disposed so as to be continuous with the first portion 612*a* on the upper wall 10*a*. Therefore, the overlapping portions 612*b*4 are disposed also on the corners 10*j*, which are defined by the projections 10*g* and the upper wall 10*a*, and the covering member 612 covers the corners 10*j*.

Because the overlapping portions 612*b*4 are disposed on the projections 10*g*, the joint area between the housing 10 and the covering member 612 can be increased. Thus, the joint strength of the housing 10 and the covering member 612 can be increased, and the joint strength of the connector 31 and the substrate 7 can be increased. As a result, the probability of removal of the connector 31 from the substrate 7 can be reduced.

Because the first protrusions 612*b*1 are disposed on the upper wall 10*a* and on the projections 10*g*, the corners 10*j*, which are defined by the projections 10*g* and the upper wall 10*a*, can be covered by the covering member 612. Thus, the corners 10*j*, which are interfaces between the projections 10*g* and the upper wall 10*a*, can be reinforced by the covering member 612. As a result, the probability of occurrence of cracks in the corners 10*j* can be reduced.

Eighth Embodiment

Figure 14A:
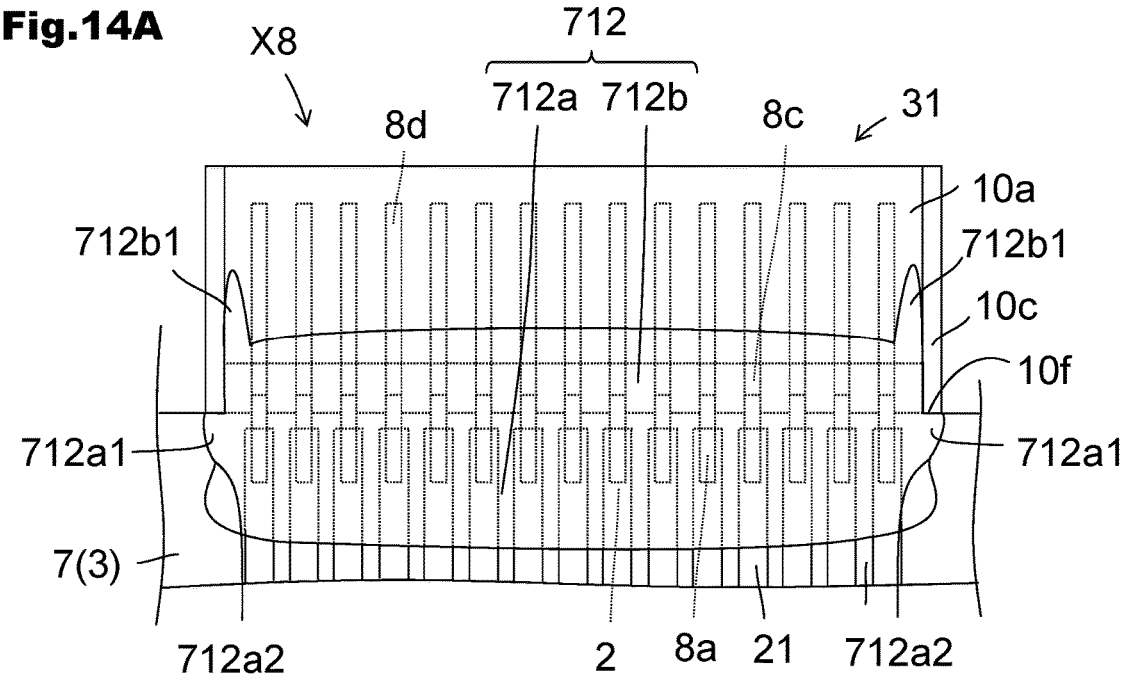
FIGS. 14A and 14B illustrate a thermal head according to an eighth embodiment.
Figure 14B:
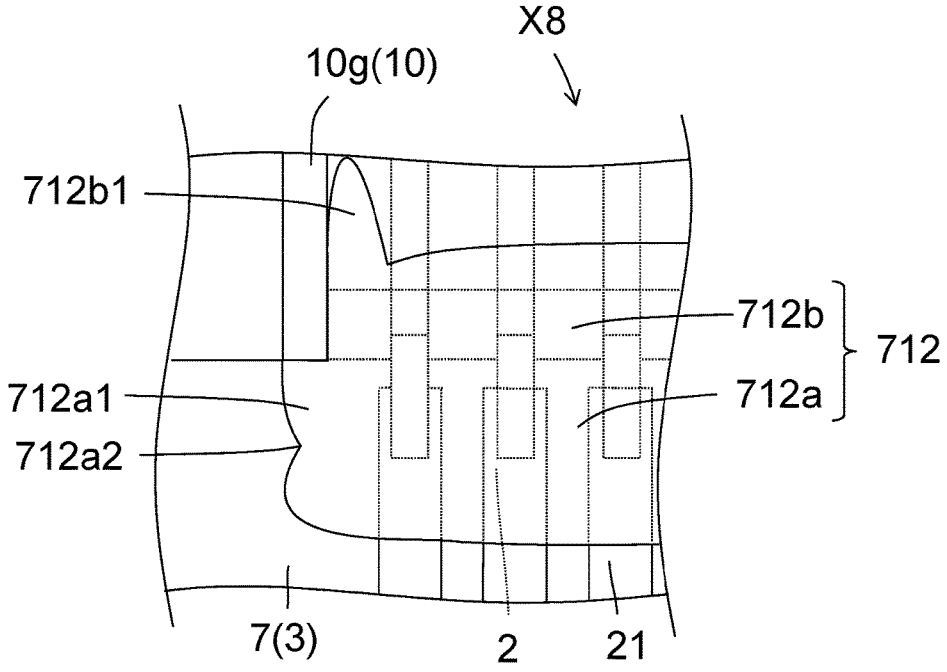

Referring to FIG. 14, a thermal head X8 will be described. The thermal head X8 differs from the thermal head X1 in the shape of a covering member 712. In other respects, the thermal head X8 is the same as the thermal head X1.

The covering member 712 includes a first portion 712*a* and a second portion 712*b*. The first portion 712*a* includes second protrusions 712*a*1, which protrude toward regions to which the projections 10*g* are extended in the sub-scanning direction in a plan view. The first portion 712*a* includes recessed portions 712*a*2, which are recessed toward the connector pins 8.

The second protrusions 712*a*1 protrude toward regions to which the projections 10*g* are extended in the sub-scanning direction in a plan view. The phrase "regions to which the projections 10*g* are extended in the sub-scanning direction"

are regions to which the projections 10*g* are extended in the sub-scanning direction and that overlap the substrate 7 in a plan view.

The second protrusions 712*a*1 are integrally formed with the first portion 712*a*. The second portion 712*b* includes first protrusions 712*b*1. The first protrusions 712*b*1 include overlapping portions 712*b*4, which are disposed on the projections 10*g*.

The first portion 712*a* includes the second protrusions 712*a*1, which protrude toward regions to which the projections 10*g* are extended in the sub-scanning direction in a plan view. Thus, the covering member 712 is disposed on the regions on the substrate 7 to which the projections 10*g* are extend in the sub-scanning direction. As a result, the contact area between the substrate 7 and the covering member 712 is increased, and the joint strength of the housing 10 and the covering member 712 can be increased. Therefore, the joint strength of the connector 31 and the substrate 7 can be increased, and the probability of removal of the connector 31 from the substrate 7 can be reduced.

In a plan view, the covering member 712 is disposed so as to surround the edges of the projections 10*g* near the substrate 7. Therefore, even when an external force is applied to the housing 10 in the left-right direction (main scanning direction) in FIG. 14A, the covering member 712 functions to absorb the external force, and the external force applied to the housing 10 can be reduced. As a result, the probability of breakage of the housing 10 can be reduced.

The recessed portions 712*a*2 are formed in the first portion 712*a* on the substrate 7 and are recessed toward the connector pins 8. The phrase "recessed toward the connector pins 8" means that the edges of the first portion 712*a* that are located at both ends in the main scanning direction are recessed toward the connector pins 8 in a plan view.

If an external force is applied to the housing 10 and a rotational moment in the clockwise or counterclockwise direction in FIG. 14A is generated, the connector 31 may be removed from the substrate 7.

To prevent this, the first portion 712*a* includes the recessed portions 712*a*2, which are recessed toward the connector pins 8 in a plan view, so that the rotational moment generated in the housing 10 acts around the recessed portions 712*a*2. As a result, the first portion 712*a* that is located farther than the recessed portions 712*a*2 from the opening (not shown) of the connector 31 functions to absorb the rotational moment. Therefore, the rotational moment generated in the housing 10 can be reduced and the probability of removal of the connector 31 from the substrate 7 can be reduced.

The present invention is not limited to the embodiments described above, which can be modified in various ways within the spirit and scope of the present invention. For example, the thermal printer Z1 includes the thermal head X1 according to the first embodiment. This is not a limitation, and the thermal heads X2 to X8 may be used for the thermal printer Z1. The thermal heads X1 to X8 according to the embodiments may be used in combination.

In the thermal heads X1 to X8, the connector 31 is disposed at a central portion in the main scanning direction. However, the connector 31 may be disposed at each of two ends in the main scanning direction.

In the above examples, the thermal heads are thin-film heads in which the resistor layer 15 is formed as a thin film and the heating elements 9 are thin. However, this is not a limitation. For example, the present invention may be used for a thick-film head in which the resistor layer 15 is formed as a thick film after patterning various electrodes. The present technology may be used for an end-surface head in which the heating elements 9 are formed on an end surface of the substrate 7.

In the above examples, the connection terminals 2 of the thermal head X1 are directly connected to the connector pins 8. However, this is not a limitation. For example, the head base body 3 and the connector 31 may be electrically connected to each other by using an independent wiring substrate and by electrically connecting one terminal of the wiring substrate to the connection terminals 2 and electrically connecting the other terminal of the wiring substrate to the connector pins 8.

Without forming the bulging portion 13*b* on the heat storage layer 13, the heating elements 9 of the resistor layer 15 may be disposed on the base portion 13*a* of the heat storage layer 13. The heat storage layer 13 may be disposed over the entire upper surface of the substrate 7.

The heating elements 9 may be formed by forming the common electrode 17 and the individual electrodes 19 on the heat storage layer 13 and forming the resistor layer 15 only in regions between the common electrode 17 and the individual electrodes 19.

The covering member 12 may be made of a material that is the same as the hard coating 29, which covers the drive ICs 11. In this case, the hard coating 29 and the covering member 12 may be simultaneously formed by performing printing on a region in which the covering member 12 is formed when printing the hard coating 29.

REFERENCE SIGNS LIST

X1 to X8 thermal head
Z1 thermal printer
1 heat sink
2 connection terminal
3 head base body
4 ground electrode
7 substrate
8 connector pins
9 heating element
10 housing
10*a* upper wall
10*b* lower wall
10*c* side wall
10*d* front wall
10*e* extension portion
10*f* positioning portion
10*g* projection
10*i* opening
11 drive IC
12 covering member
12*a* first portion
12*b* second portion
12*b*1 first protrusion
13 heat storage layer
15 resistor layer
17 common electrode
19 individual electrode
21 IC-connector connection electrode
23 joining material
25 protective layer
26 IC-IC connection electrode
27 covering layer
29 hard coating
32 connection portion

The invention claimed is:

1. A thermal head comprising:
a substrate;
heating elements disposed on the substrate;
electrodes disposed on the substrate and electrically connected to the plurality of heating elements;
a connector adjacent to the substrate and comprising:
connector pins including connection portions, each of the connection portions electrically connected to a corresponding one of the electrodes; and
a housing containing the connector pins; and
a covering member covering the connection portions on the substrate,
wherein the housing comprises an opening facing away from the substrate,
wherein the covering member comprises:
a first portion located on the substrate; and
a second portion located on the housing, and
wherein the second portion comprises a first protrusion protruding toward the opening in a plan view.

2. The thermal head according to claim 1, wherein the first protrusion is disposed at each of two end portions of the housing in a main scanning direction.

3. The thermal head according to claim 1, wherein
the housing comprises:
an upper wall,
a lower wall,
a pair of side walls connecting the upper wall and the lower wall, and
a front wall connecting the upper wall, the lower wall and the pair of side walls, and
the opening is formed by the upper wall, the lower wall, the pair of side walls, and the front wall,
wherein the housing comprises a projection disposed at each of two end portions of the upper wall in a main scanning direction, the projection projecting from the upper wall in a sub-scanning direction, and
wherein the first protrusion is disposed at a corner formed by the projection and the upper wall.

4. The thermal head according to claim 3, wherein a width of the projection in the main scanning direction is greater than a width of a side wall of the pair of side walls in the main scanning direction.

5. The thermal head according to claim 3, wherein
the housing further comprises a first groove formed along the sub-scanning direction, in the upper wall and adjacent to the projection; and
the first protrusion is disposed in the first groove.

6. The thermal head according to claim 3, wherein
the housing further comprises a second groove formed along the sub-scanning direction in the projection, and
the first protrusion is disposed in the second groove.

7. The thermal head according to claim 3, wherein
the projection further comprises a cutout near the opening, and
the first protrusion is disposed in the cutout.

8. The thermal head according to claim 7, wherein
the housing further comprises a third groove formed along the main scanning direction at the cutout in the upper wall, and
the first protrusion is disposed in the third groove.

9. The thermal head according to claim 7, wherein
the projection further comprises a fourth groove formed along the main scanning direction and adjacent to the cutout, and
the first protrusion is disposed in the fourth groove.

10. The thermal head according to claim 3, wherein the first protrusion is disposed also on the projection.

11. The thermal head according to claim 3, wherein the first portion comprises a second protrusion disposed on a region to which the projection is extended in the sub-scanning direction in the plan view.

12. The thermal head according to claim 1, wherein the first portion comprises a recessed portion that is recessed toward the connector pins in the plan view.

13. A thermal printer comprising:
the thermal head according to claim 1;
a transport mechanism that transports a recording medium onto the heating elements; and
a platen roller that presses the recording medium against the heating elements.

14. A thermal head comprising:
a substrate;
heating elements disposed on the substrate;
electrodes disposed on the substrate and electrically connected to the plurality of heating elements;
a connector adjacent to the substrate and comprising:
connector pins including connection portions, each of the connection portions electrically connected to a corresponding one of the electrodes; and
a housing containing the connector pins; and
a covering member covering the connection portions on the substrate,
wherein the covering member comprises:
a first portion located on the substrate; and
a second portion located on the housing, and
wherein the first portion comprises a recessed portion that is recessed toward the connector pins in a plan view.

15. A thermal printer comprising:
the thermal head according to claim 14;
a transport mechanism that transports a recording medium onto the heating elements; and
a platen roller that presses the recording medium against the heating elements.

* * * * *